US005810102A

United States Patent [19]

Stewart

[11] Patent Number: 5,810,102

[45] Date of Patent: Sep. 22, 1998

[54] REVERSIBLE BIT ASSEMBLY

[76] Inventor: Gary L. Stewart, 710 Greenwood Ct., Georgetown, Tex. 78628

[21] Appl. No.: 702,358

[22] Filed: Aug. 23, 1996

[51] Int. Cl.[6] ..... E21B 10/00

[52] U.S. Cl. ..... 175/401; 299/104; 299/113

[58] Field of Search ..... 175/354, 401, 175/424; 299/104, 106, 108, 113

[56] References Cited

U.S. PATENT DOCUMENTS

| | | | |
|---|---|---|---|
| 1,964,030 | 6/1934 | Brush . | |
| 2,186,502 | 1/1940 | Simmons . | |
| 2,543,861 | 3/1951 | Mader . | |
| 2,610,049 | 9/1952 | Elles et al. . | |
| 2,915,290 | 12/1959 | Petersen | 299/108 X |
| 3,342,531 | 9/1967 | Krekeler . | |
| 3,493,268 | 2/1970 | Bower, Jr. . | |
| 3,519,309 | 7/1970 | Engle et al. . | |
| 3,796,464 | 3/1974 | Hansen et al. | 299/104 |
| 4,159,746 | 7/1979 | Wrulich et al. . | |
| 4,340,328 | 7/1982 | Proulx et al. . | |
| 5,374,111 | 12/1994 | Den Besten et al. | 299/106 |
| 5,456,522 | 10/1995 | Beach | 299/113 |
| 5,470,180 | 11/1995 | Jore . | |

*Primary Examiner*—Roger J. Schoeppel
*Attorney, Agent, or Firm*—Christensen, O'Connor, Johnson & Kindness PLLC

[57] ABSTRACT

A reversible bit assembly (8) that includes a reversible bit (10) having a shank (20) and a radially enlarged center portion (22) located midway along the longitude of the shank (20). Opposed cutting tips (24) are located at opposed shank ends (23). The bit (10) is insertable into a bore (12) of a bit block (14) and held therein using a retention mechanism. A preferred retention mechanism includes a circumferential groove (34) in the bit center portion (22) and a cross hole (38) in the bit block (14) located tangent to the bore (12) at a position corresponding to the location of the groove (34) when the bit (10) is inserted in the block (14). A pin (46) inserts into the cross hole (38) to retain the bit (10) at the groove (34). An adaptor sleeve (16) is provided that may be inserted into the block (14) to additionally allow known bits (18) to be used in the block (14).

18 Claims, 2 Drawing Sheets

REVERSIBLE BIT ASSEMBLY

FIELD OF THE INVENTION

The present invention relates to bits used in drilling, mining, and trenching, and more particularly, to reversible bits having a circular cross-section suitable for loosening compacted earth, cutting or drilling rock, etc.

BACKGROUND OF THE INVENTION

Current bits have a generally cylindrical shank and a conical cutting tip. The cutting tip includes a hard, durable end material such as tungsten carbide. When the bit is impacted, the conical shape of the tip encourages the bit to rotate about its longitudinal axis, thereby creating a self-sharpening action on the tip point. Such bits are suitable for cutting rock, coal, asphalt, concrete, and other hard and abrasive materials. Depending on the characteristics of the material, the useful life of a bit can range between less than an hour and several days.

Because of the extreme application required in the use of these bits, it would be very desirable if a bit were constructed with two opposed cutting tips and reversible, thereby doubling its useful life. U.S. Pat. No. 3,493,268 describes a reversible cutting bit having two circumferential recesses or grooves spaced apart along a bit shank for retaining the bit. One recess is located between each shank end and an enlarged center portion. The bit is inserted in a bit block bore and retained therein using a pin extending through the block and tangentially through the circumferential recess located within the bit block.

This reversible bit suffers from a number of disadvantages. A first disadvantage is that one recess is always exposed to the severe work environment during use. This increases the chances that the exposed recess will be damaged. Any damage to the groove can hinder bit rotation when the bit is reversed. Without rotation, the bit will not self-sharpen and will fail quickly. Severe damage to the exposed portions of the bit can also result in the bit being unfit for retention in the bore. Thus, the bit may not be reversed for secondary use because the damaged groove my not accept the retaining pin or the pin may not have a groove within which to hold the bit. A second disadvantage is that the portions of the bit at the base of the circumferential grooves have a smaller cross-sectional area than the other shank portions. Therefore, the recesses are structurally the weakest locations along the bit and are prone to prematurely fail.

There exists a need for a reversible bit that is not prone to breakage and that shields the circumferential groove or other retention mechanisms from the severe work environment during use. The present invention is directed to fulfilling this need.

SUMMARY OF THE INVENTION

A principal object of the present invention is to provide a reversible bit of the type having a shank with opposed cutting tip ends, thereby offering twice the life of non-reversible bits. It is also an object to avoid the disadvantages of prior reversible bits by providing a reversible bit that is not prone to breakage and that shields and protects its retaining mechanisms from the severe work environment.

A reversible bit assembly formed in accordance with the present invention includes a bit having opposed cutting tips. The bit is insertable into a bore of a bit block and held therein using a retention mechanism. The reversible bit includes a generally cylindrical shank and a radially enlarged center portion located midway along the shank between opposed tip ends. The cutting tips preferably include an arrangement of a hard tip connected to each shank end. Beveled shoulders are formed between the enlarged center portion and the shank. The bit block includes a first larger diameter portion sized to closely receive the bit center portion and a second smaller diameter portion sized to closely receive a bit shank end. A beveled shoulder is provided between the bore first and second portions for supporting a bit shoulder during use.

In accordance with aspects of the invention, a preferred retention mechanism includes a circumferential groove extending around the bit center portion. A cross hole in the bit block is located tangent to the bore at a position corresponding to the location of the circumferential groove when the bit is inserted in the block. A pin inserts into the hole and the bit groove to retain the bit within the bore, while allowing the bit to rotate. The groove, pin, and cross hole are each preferably of a circular cross-sectional shape. The cross-sectional area of the bit at the bottom of the groove is preferably larger than the cross-sectional area of the shank.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

The present invention relates to drilling, planing, milling, mining, and trenching technology in which a bit or tooth is used to loosen compacted earth or to drill solid rock and the like. In general, a reversible bit assembly 8, formed in accordance with the present invention includes a reversible bit 10 insertable into a stepped bore 12 of a bit block 14 and held therein using a retention mechanism.

Figure 1:
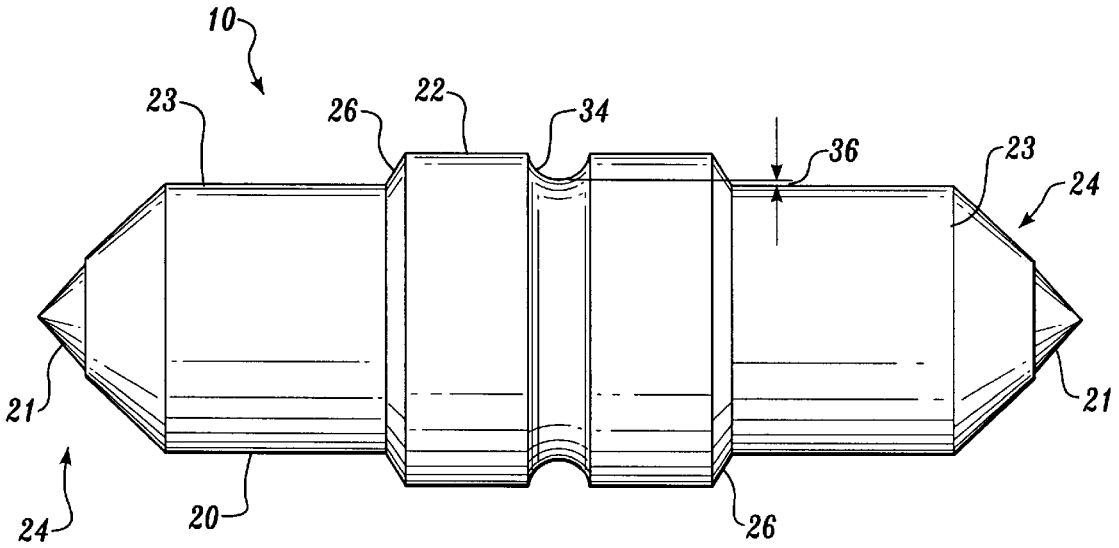
FIG. 1 is a side view of a reversible bit formed in accordance with the present invention.

Referring to FIG. 1, the reversible bit 10 includes a generally cylindrical shank 20 having opposed cutting tips 24. Each cutting tip includes a generally conical hard tip 21 attached to a shank end 23. The hard tips 21 may be formed of any one of a number of known materials, e.g., tungsten carbide or other ultra-hard material. Various sizes, shapes, and arrangements of cutting tips 21 are currently known, the selection of which for use in the present invention will depend on the precise application. Similarly, the sizing of the overall bit will vary according to the needs of a specific task. For example, different applications require different bit lengths in order to accomplish the proper bit penetration into a specific material.

Still referring to FIG. 1, the reversible bit 10 further includes a center portion 22 located generally midway between the cutting tips 24. The center portion 22 has a diameter larger than the shank diameter. Bit shoulders 26 are provided to transition between the center portion 22 and the shank 20. The shoulders 26 provide a seating surface for the bit 10 so as to transmit bit forces to the bit block 14 during use. The shoulders 26 are preferably beveled to reduce the shear load at the shoulder from the longitudinal forces acting between the shoulder and the bore 12.

Figure 2:
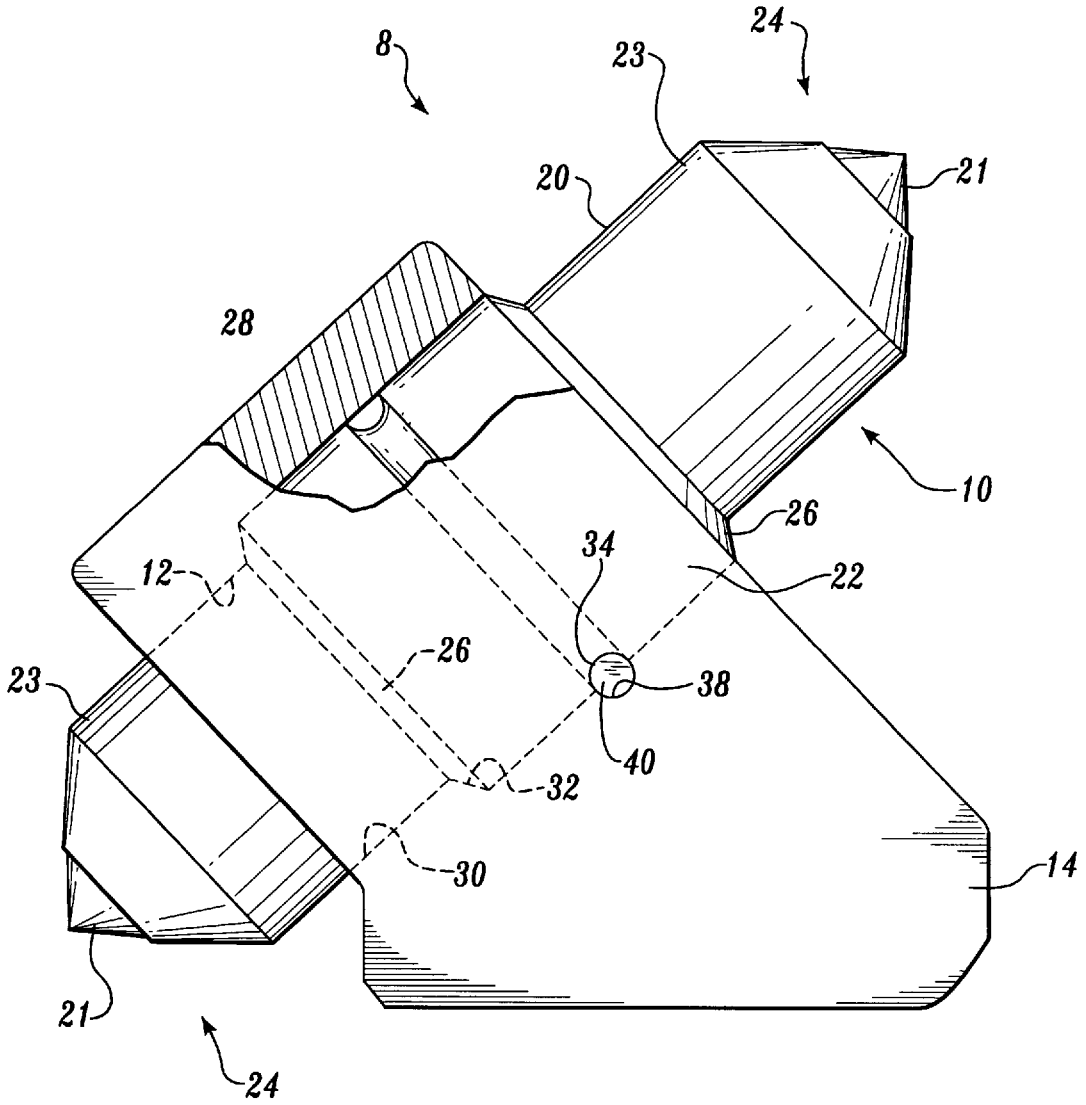
FIG. 2 is a side view of a reversible bit assembly formed in accordance with the present invention illustrating the reversible bit of FIG. 1 as inserted in a bit block, portions of the assembly being shown in phantom and as cut-away for illustrative purposes.

As shown in FIG. 2, the reversible bit 10 is inserted into the stepped bore 12 located in the bit block 14. In a preferred embodiment, the bore 12 includes a first portion 28 sized to closely receive the bit center portion 22 and a second portion 30 sized to closely receive the bit shank 20. Therefore, the bore first and second portions 28, 30 are of differing diameters with the first portion 28 being larger than the second portion 30. Similar to the bit 10, the bore 12 preferably further includes a shoulder 32 to bridge the exterior surfaces of the bore first and second portions 28, 30. The bore shoulder 32 should correspond to the shape of the bit shoulders 26.

A preferred embodiment of a retention mechanism is illustrated in FIG. 2. There shown, a circumferential groove 34 is formed in the bit center portion 22 located centrally relative to the length of the bit 10. The groove 34 extends about the entire periphery of the center portion 22 in order that the bit 10 may rotate and self-sharpen during use. The groove is located at the maximum cross-sectional area of the center portion. It is preferred that only a single groove be used, thereby offering the fewest number of potential breakage points. Having a single groove also frees the retention mechanism from carrying loads, and instead allows the shoulders 26 to transmit loads to the block.

The cross-sectional area of the center portion at the bottom of the groove 34 should be at least as large as the shank cross-sectional area. This is indicated in FIG. 1 by an excess radial distance labeled number 36. This ensures that the groove 34 will not be the weakest point in the bit 10. Such an increased bit diameter at the retention groove 34 provides a much stronger bit.

Referring back to FIG. 2, a cross hole 38 is formed in the bit block 14, with the hole's centerline located at a tangent to the bore first portion 28. The hole 38 is located through the block 14 such that the hole aligns with the bit circumferential groove 34. The reversible bit 10 is inserted in the internal bore 12, and a pin 40 is inserted in the block hole 38. The pin 40 engages the bit groove 34, causing the bit 10 to be retained within the bore 12. The groove 34, pin 40, and cross hole 38 are each of a circular cross section having a similar radial size, thus allowing the bit to rotate during use. Other shapes may be used for the groove, pin, and cross hole; however, they are not preferred.

Variations of the above described preferred retention mechanism are possible. It is important to the present invention, however, that the selected retention mechanism allow the bit 10 to rotate, as well as maintain high structural integrity. It is also important that the retention mechanism be located at the bit center portion 22 in such a manner as to be protected or shielded from the abusive work environment. With regard to the retention mechanism shown in FIG. 2, the bit groove 34 is entirely protected from damage from flying rock and debris, since the groove 34 is encapsulated by the block 14. When one bit tip is worn, the bit 10 may be easily reversed so that the opposite bit end may then be used. Thus, the life of the bit is doubled.

While preferred embodiments of the invention have been illustrated and described, it will be apparent that various changes can be made therein without departing from the spirit and scope of the invention. For example, sealing rings may be used to seal the circular seam located between the bit 10 and the block 14, various tip arrangements may be used, etc. In addition, the present invention may be formed in a wide variety of sizes and relative shapes.

The embodiments of the invention in which an exclusive property or privilege is claimed are defined as follow:

1. A reversible bit assembly comprising:

(a) a reversible bit comprising a generally cylindrical shank having opposed cutting tips, the shank having a center portion located generally midway between the cutting tips, the center portion diameter being larger than the shank diameter;

(b) a bit block for supporting the reversible bit, the block comprising a bore; and (c) a protected retention mechanism located within the bore at a location approximately midway along the length of the center portion, whereby the reversible bit is inserted into the bore of the bit block and retain mechanism comprising:

(i) at least one circumferential groove located in the bit center portion, wherein the cross-sectional area of the center portion at the base of the at least one groove is at least as large as the shank cross-sectional area;

(ii) a cross hole extending through the bit block at a location tangent to the bore, the cross hole being positioned to align with the circumferential groove; and (iii) a pin for insertion into the cross hole, the pin thereby retaining the bit at its groove in the bit block.

2. The reversible bit assembly according to claim 1, wherein the bore includes a first larger diameter portion sized to closely receive the bit center portion and a second smaller diameter portion sized to closely receive a bit shank.

3. The reversible bit assembly according to claim 2, wherein the bit further comprises a shoulder between the center portion and the shank, and the bore further comprises a shoulder between the bore first and second portions corresponding in shape to the bit shoulder, loads being transmitted between the bit and bore shoulders during use.

4. The reversible bit assembly according to claim 1, wherein the at least one circumferential groove is a single groove and wherein during use the single groove is enclosed entirely within the bit block.

5. The reversible bit assembly according to claim 1, wherein the bore includes a first larger portion sized to closely receive the bit center portion and a second smaller portion sized to closely receive a bit shank end.

6. The reversible bit assembly according to claim 1, wherein the groove pin, and cross hole are each of a circular cross section having a similar radial size.

7. A reversible bit comprising a generally cylindrical shank having opposed cutting tips, the shank adapted to be inserted into a bore in a bit block, and a center portion located generally midway between the opposed cutting tips, the center portion including a circumferential groove for use in retaining the reversible bit in a bit block bore, wherein the cross-sectional area of the center portion at the base of the groove is at least as large as the shank cross-sectional area.

8. The reversible bit according to claim 7, wherein the circumferential groove is a single circumferential groove that is substantially unloaded during normal use.

9. The reversible bit according to claim 7, wherein the groove has a generally semi-circular cross-sectional shape.

10. The reversible bit according to claim 7, wherein the circumferential groove is located approximately midway along the center portion.

11. A reversible bit assembly comprising:

(a) a reversible bit comprising a cylindrical shank having opposed cutting tips, the shank having a cylindrical center portion, the center portion diameter being larger than the shank diameter;

(b) a bit block for supporting the reversible bit, the block comprising a cylindrical bore; and (c) a single retention mechanism located within the bore comprising at least one circumferential groove located in the bit center portion, a cross hole extending through the bit block at a location tangent to the bore, the cross hole being positioned to align with the circumferential groove, and a pin for insertion into the cross hole, the pin retaining the bit at its groove in the bit block;

wherein during use, the retention mechanism permits the reversible bit to rotate freely in the bore.

12. The reversible bit assembly according to claim 11, wherein the cross-sectional area of the center portion at the base of the at least one groove is at least as large as the shank cross-sectional area.

13. The reversible bit assembly according to claim 11, wherein the bore includes a first portion sized to closely receive the bit center portion and a second portion sized to closely receive a bit shank, the first portion being of larger cross-sectional diameter than the second portion cross-sectional diameter.

14. The reversible bit assembly according to claim 13, wherein the bit further comprises a shoulder between the center portion and the shank, and the bore further comprises a shoulder between the bore first and second portions corresponding in shape to the bit shoulder, loads being transmitted between the bit and bore shoulders during use.

15. A reversible bit comprising a cylindrical shank having opposed cutting tips, the shank being adapted to be inserted into a bore in a bit block; the reversible bit further comprising a cylindrical center portion located midway between the opposed cutting tips, the center portion including a circumferential groove for use in retaining the reversible bit in the bore using a pin in a manner that permits rotation though prohibits translation therein.

16. The reversible bit according to claim 15, wherein the center portion has a diameter that is larger than the shank diameter.

17. The reversible bit according to claim 16, wherein the cross-sectional area of the center portion at the base of the groove is at least as large as the shank cross-sectional area.

18. The reversible bit according to claim 15, wherein the circumferential groove is a single circumferential groove that is substantially unloaded during normal use.

* * * * *

UNITED STATES PATENT AND TRADEMARK OFFICE

CERTIFICATE OF CORRECTION

PATENT NO. : 5,810,102
DATED : September 22, 1998
INVENTOR(S) : G.L. Stewart

It is certified that error appears in the above-identified patent and that said Letters Patent is hereby corrected as shown below:

| COLUMN | LINE | |
|---|---|---|
| 4 (Claim 1, | 14 line 12) | "retain" should read --retained therein by the retention mechanism, the retention-- |
| 4 (Claim 6, | 45 line 2) | after "groove" insert --,-- |

Signed and Sealed this

Ninth Day of February, 1999

*Attest:*

*Attesting Officer*

*Acting Commissioner of Patents and Trademarks*